US005965884A

United States Patent [19]

Laiko et al.

[11] Patent Number: 5,965,884

[45] Date of Patent: Oct. 12, 1999

[54] ATMOSPHERIC PRESSURE MATRIX ASSISTED LASER DESORPTION

[75] Inventors: Victor V. Laiko, San Francisco; Alma L. Burlingame, Sausalito, both of Calif.

[73] Assignee: The Regents of the University of California, Oakland, Calif.

[21] Appl. No.: 09/090,764

[22] Filed: Jun. 4, 1998

[51] Int. Cl.[6] ..... H01J 49/10

[52] U.S. Cl. ..... 250/288

[58] Field of Search ..... 250/288, 281, 250/282

[56] References Cited

U.S. PATENT DOCUMENTS 5,663,561 9/1997 Franzen et al. ..... 250/288

*Primary Examiner*—Kiet T. Nguyen
*Attorney, Agent, or Firm*—Lumen Intellectual Property Services

[57] ABSTRACT

An Atmospheric Pressure Matrix-Assisted Laser Desorption Ionization (AP-MALDI) apparatus is for connecting to a mass spectrometer. This apparatus provides an ion source using matrix-assisted laser desorption and ionization at or near atmospheric pressure. The apparatus has non-destructive ion source having the characteristics of versatility, simplicity.

9 Claims, 7 Drawing Sheets

ATMOSPHERIC PRESSURE MATRIX ASSISTED LASER DESORPTION

FIELD OF THE INVENTION

This invention relates generally to the field of mass spectroscopy, and especially to sample preparation sources used in mass spectroscopy.

BACKGROUND

Mass spectrometers are widely used in analytical chemistry. Mass analysis of any sample used in a mass spectrometer assumes the production of analyte ions in gas phase or vacuum as a first step. Ion sources of several types have been invented for this purpose. All sample ionization techniques may be divided into two groups: vacuum ionization ion sources and atmospheric pressure ionization sources. The first group includes such techniques as electron impact ionization, fast ion bombardment and secondary ion ionization. A characteristic feature of these ionization sources is that sample ionization occurs inside a mass spectrometer housing under vacuum conditions. The second group, atmospheric pressure ionization sources, includes atmospheric pressure chemical ionization and Electrospray Ionization (ESI). The difference between these two groups of ionization methods is not just quantitative (a value of pressure under which a particular source is operating) but qualitative. First, any atmospheric pressure ionization takes place outside a mass spectrometer instrument. Second, different instrument types are used in both cases. To sample atmospheric pressure ions any mass spectrometer must be equipped with Atmospheric Pressure Interface (API) to transfer ions from an external region of atmospheric pressure to a mass analyzer under high vacuum. Ions produced under atmospheric pressure conditions may be used for other analytical purposes, too. For example, they are used in Ion Mobility Spectroscopy (IMS), which is a fast growing branch of analytical chemistry. Standard IMS instruments operate under pressures close to atmospheric. Thus, only ion sources of the second group (atmospheric pressure ion sources) are used in combination with IMS, because the problem of ion transfer from vacuum to atmosphere against a gas stream has not been solved.

Two major achievements ensure the fast development of modern mass spectroscopy as a powerful tool in analytical chemistry. These are Matrix Assisted Laser Desorption Ionization (MALDI) and Electrospray Ionization (ESI) techniques. Both MALDI and ESI enable the production of intact heavy molecular ions from a condensed phase (solid phase for MALDI and liquid phase for ESI) to be mass analyzed under high vacuum conditions. At the present time, MALDI typically takes place inside a mass spectrometer under high vacuum conditions while ESI is an atmospheric pressure ion source. However, the nature of both MALDI and ESI produced ions is similar. Practical experience shows that these two ionization techniques produce overlapping results sometimes and complimentary in other cases. The advantages of MALDI include simplicity of probe preparation, stability and high tolerance to sample contamination. One of the major advantages of ESI is the atmospheric pressure character of ionization (external with respect to a mass spectrometer), which enables a direct on-line interface with other analytical separation techniques, such as HPLC, CZE, and IMS. An Atmospheric Pressure Interface(API) is used to transfer ions from an atmospheric pressure ion source, such as an ESI, to a vacuum of a mass spectrometer. This interface has an efficiency as low as a few percent. Atmospheric pressure MALDI has not been applied because of the concern that MALDI does not generate enough ions to compensate the loss of ions due to the API.

Recently, Franzen et al. developed a method, disclosed in U.S. Pat. No. 5,663,562, for ionizing heavy analyte molecules deposited on a solid support in a gas at atmospheric pressure. This method comprises two major steps. First, the analyte molecules deposited together with decomposable (explosive) matrix material are blasted into the surrounding gas under atmospheric pressure conditions as a result of decomposition of matrix material under laser irradiation. Neutral gas-phase analyte molecules are produced at this stage. Second, these neutral gas-phase analyte molecules are ionized by atmospheric pressure chemical ionization for further analysis by a mass spectrometer.

OBJECTS AND ADVANTAGES

It is therefore a primary object of the present invention to provide a novel atmospheric pressure ionization apparatus, namely, an Atmospheric Pressure Matrix Assisted Laser Desorption (AP-MALDI) apparatus.

Generally, the present invention makes it possible to record MALDI-type spectra using any type of mass spectrometer equipped with atmospheric pressure interface (API) without essential modifications. A single instrument (instead of instruments of different types) may be used to record both ESI and AP-MALDI spectra. The design of AP-MALDI source enables easy replacement of AP-MALDI source with ESI and vise versa.

AP-MALDI has the characteristics of easy sample preparation, high stability, high contamination tolerance, simple interface with other analytical separation techniques, etc.

Particularly, in comparison with the prior art taught by Franzen et al.(U.S. Pat. No. 5,663,562), the present invention simplifies the sample evaporation and ionization process to a single step under the atmospheric pressure. Yet another characteristics of the invention is that the sample preparation process of the present invention is non-destructive, which makes the present invention particularly useful for analyzing large bio-molecules. An important advantage of the invention include the possibility to use the same matrix solution and sample preparation procedure as is commonly used for a conventional vacuum MALDI, and the similarity of recorded spectra with corresponding conventional MALDI spectra.

Further objects and advantages will become apparent upon reading the specification.

SUMMARY

The objects and advantages are attained by an Atmospheric Pressure Matrix Assisted Laser Desorption/Ionization apparatus (AP-MALDI) for connection to a spectrometer. The AP-MALDI apparatus mainly consists three parts: an atmospheric pressure ionization chamber which hosts a sample to be analyzed; a laser system outside the ionization chamber for illuminating the sample in the ionization chamber; and an interface which connects the ionization chamber to the spectrometer.

The ionization chamber is used to control the gas nature, pressure, temperature, and humidity if these parameters differ from that of ambient air. In some cases, additional equipment is incorporated in the ionization chamber to control these parameters, such as a heater to control the temperature. In cases when the ionization process is conducted in ambient air, even the use of the ionization chamber is optional.

The ionization chamber typically comprises a bath gas inlet as a pathway for the bath gas to enter the chamber. Normally, the ionization chamber is filled with a bath gas at or near atmospheric pressure. The bath gas, which is normally selected from the group which comprises inert gas, nitrogen gas, and gas mixer such as air, is chosen such that it does not react with the sample or by itself, even under laser illumination.

The ionization chamber further comprises a window through which the illuminating laser beam enters. The position of the window is correlated to the position of the sample to be illuminated inside the ionization chamber. In a preferred embodiment, the window is positioned at the side of the chamber.

The sample, also referred to as the target material, normally comprises a mixture of analyte materials and light-absorbing matrix substances. The sample is in a form selected from the group of solid phase and liquid phase. The sample is deposited on a target surface of a sample support. When illuminated with the laser beam, the matrix molecules are ionized and evaporated. The ionized matrix molecules subsequently ionize the analyte molecules through charge transfer process. At the same time, the analyte molecules, analyte ions and fragmented analyte ions are evaporated together with the matrix ions and molecules. Examples of matrix substances are α-cyano-4-hydroxycinnamic acid, sinapinic acid and 3-hydroxypicolinic acid.

Normally, the sample support is positioned inside the ionization chamber so that the deposited sample is close to an inlet orifice of the interface between the ionization chamber and the spectrometer, and so that the sample is easily illuminated by the laser beam. This sample support is normally selected from the group comprising insulating materials and conductive materials. If the sample support is conductive, it is normally used as an electrode to provide an electric field that moves the ionized analyte from the target surface to the inlet orifice on the interface through which the ionized analyte enter the spectrometer. If the sample support is insulating, an separate electrode is needed to provide the electric field required for ion transportation.

The interface between the ionization chamber and the spectrometer is a normal interface widely used in electrospray ionization spectrometers. The interface has a inlet orifice to allow the ionized analyte to enter the spectrometer from the ionization chamber. The inlet orifice is further applied with an electric potential to serve as an electrode. The electric potential differences between the inlet orifice and the other electrodes, i.e. the sample support and the additional electrode, generate the electric field to move the ionized analyte.

The electric potential of the inlet orifice and the other electrodes, such as the sample support, are adjusted to achieve the best signal in the spectrometer. The adjustment procedure is obvious to a person skilled in the art.

In another embodiment, an additional gas nozzle is incorporated into the ionization chamber. The function of the additional gas nozzle is to provide a gas flow which pneumatically assist the ion formation process and the ion transportation process.

The laser system comprises a pulsed laser and optics. The laser typically operates in the wavelength range selected from the group comprising ultraviolet (UV), visible, and infrared (IR). The laser beam is focused by a focusing lens positioned outside the ionization chamber. The position of the lens is adjusted to change the laser spot size on the target surface. The power of the laser beam and the position of the lens is chosen to optimize the signal of the spectrometer, which is obvious to one of average skill in the art.

DETAILED DESCRIPTION

Figure 1:
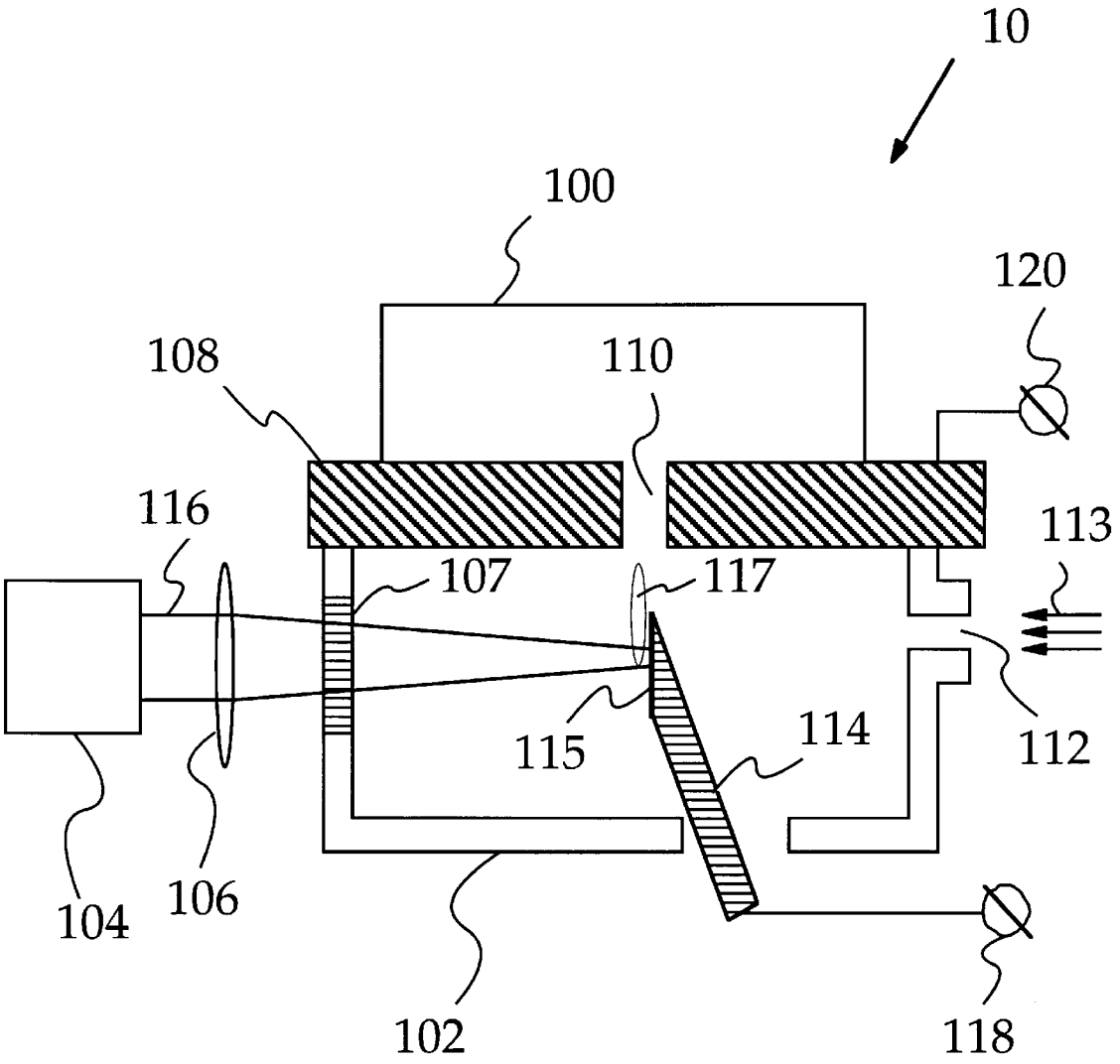
FIG. 1 is a schematic of an embodiment of an AP-MALDI apparatus.

FIG. 1 represents a basic construction of an AP-MALDI apparatus 10. This AP-MALDI apparatus 10 comprises a ionization chamber 102, an interface 108 for connecting the ionization chamber 102 to a spectrometer 100, a sample support 114 with sample deposited on its target surface 115, a laser 104, and a lens 106 for focusing a laser beam 116 generated by laser 104.

The ionization chamber 102 is used to contain a bath gas or gas mixture 113 which is at atmospheric pressure or near atmospheric pressure. Dry nitrogen and dry air is normally used as the bath gas 113. A gas inlet 112 is incorporated in the gas chamber which provides the pathway for the bath gas 113 to enter the ionization chamber 102. The ionization chamber 102 also has a window 107 for the laser beam 116 to enter the chamber 102. Additional equipment can be incorporated into the ionization chamber 102 to further control the humidity, the temperature and the pressure of the bath gas 113.

The interface 108, which is usually part of the spectrometer 100, comprises a inlet orifice 110, through which ionized analyte particles 117 enter the spectrometer 100 from the ionization chamber 102. The inlet orifice 110 is connected to a electric power supply 120 to serve as an electrode.

The sample support is also connected to an electric power supply 118 which also serves as an electrode. The two electrodes of the inlet orifice 110 and the sample support 114 provide the electric field which helps move the ionized analyte 117 from the sample support 114 to the inlet orifice 110. The electric potential applied to electrode 110 and 114 is adjusted to optimize the signal level measured by the spectrometer 100.

The sample is deposited on a target surface 115 of the sample support 114 which is aligned with the inlet orifice 110 of the interface 108 to facilitate the ionized analyte 117 to move to the inlet orifice 110.

The laser 104 positioned outside the ionization chamber 102 is a UV laser, a visible laser or an IR laser. The laser beam 116 is focused by a lens 106. The position of the lens is adjusted so that best measurement result is achieved by the spectrometer 100. In this embodiment, the lens 106 is positioned so that the focus of the laser beam 106 is 20–30 millimeters away from the target surface 115.

Figure 2:
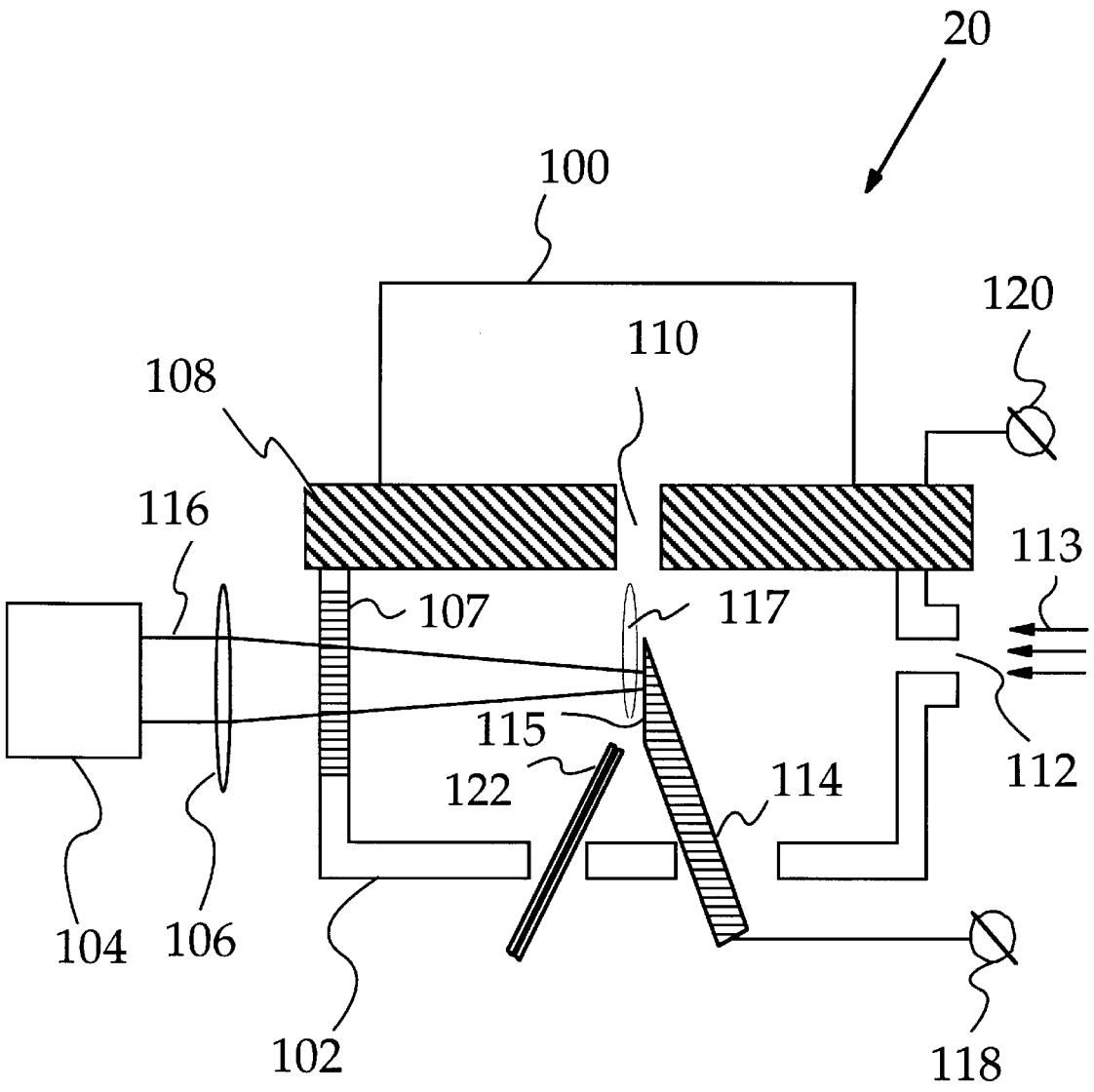
FIG. 2 is a schematic of another embodiment of an AP-MALDI apparatus incorporating a gas nozzle to assist the transportation of ionized analyte.

FIG. 2 represents another embodiment 20 of AP-MALDI which is a variant of the embodiment 10 illustrated in FIG. 1. Embodiment 20 is also called "Pneumatically Assisted AP-MALDI". A gas nozzle 122 is introduced in the vicinity of the target surface 115 of the sample support 114. A gas flow is produced alongside the target surface 115 towards the inlet orifice 110. This gas flow assists the movement of the ionized analyte 117 from the target surface 115 to the nozzle inlet 110, and helps to improve the sensitivity of the apparatus. This kind of arrangement is not applicable in a conventional vacuum MALDI apparatus.

Figure 3:
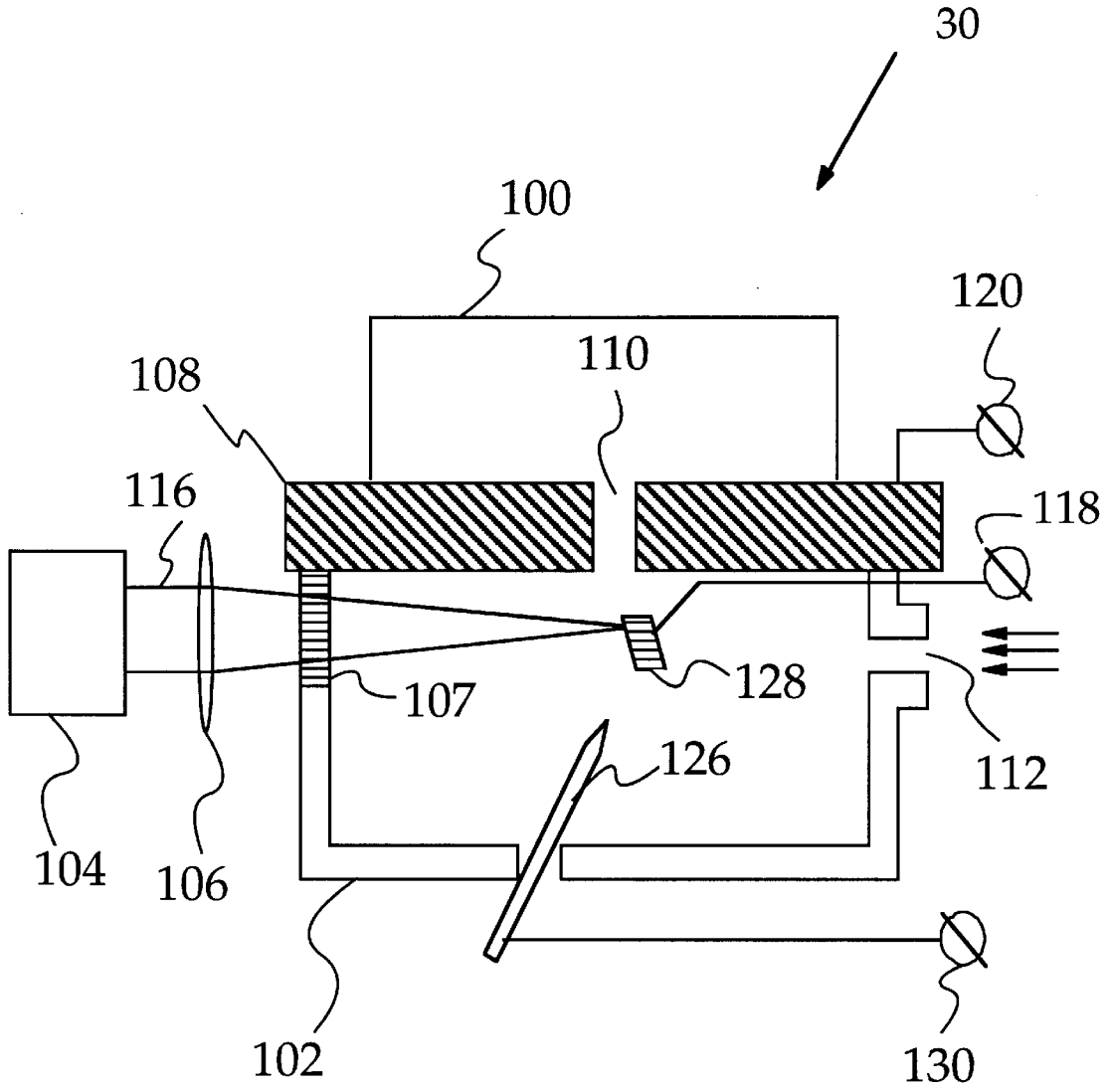
FIG. 3 is a schematic of another embodiment of an AP-MALDI apparatus incorporating an additional electrode to assist the transportation of ionized analyte.

FIG. 3 illustrate another embodiment 30 of the invention. In comparison with the embodiment 10, embodiment 30 has an additional electrode 126 connected to the electric power supply 130. The sample support 114 of embodiment 10 is replaced by a sample support 128 in embodiment 30. Similar to embodiment 10, conductive sample support 128 is connected to the power supply 118 to serve as an electrode. In this embodiment, the electric field for driving the ionized analyte is mainly provided by the additional electrode 126 and the inlet orifice 110. The sample support 128 can also be insulating to minimize the perturbation to the electrical field near the inlet orifice 110. The advantage of this arrangement over the embodiment 10 is that the sample support 128 can be positioned close to the inlet orifice 110, so that more ionized analytes enter the spectrometer. As a result, the sensitivity of the AP-MALDI mass spectrometer is higher.

Figure 4:
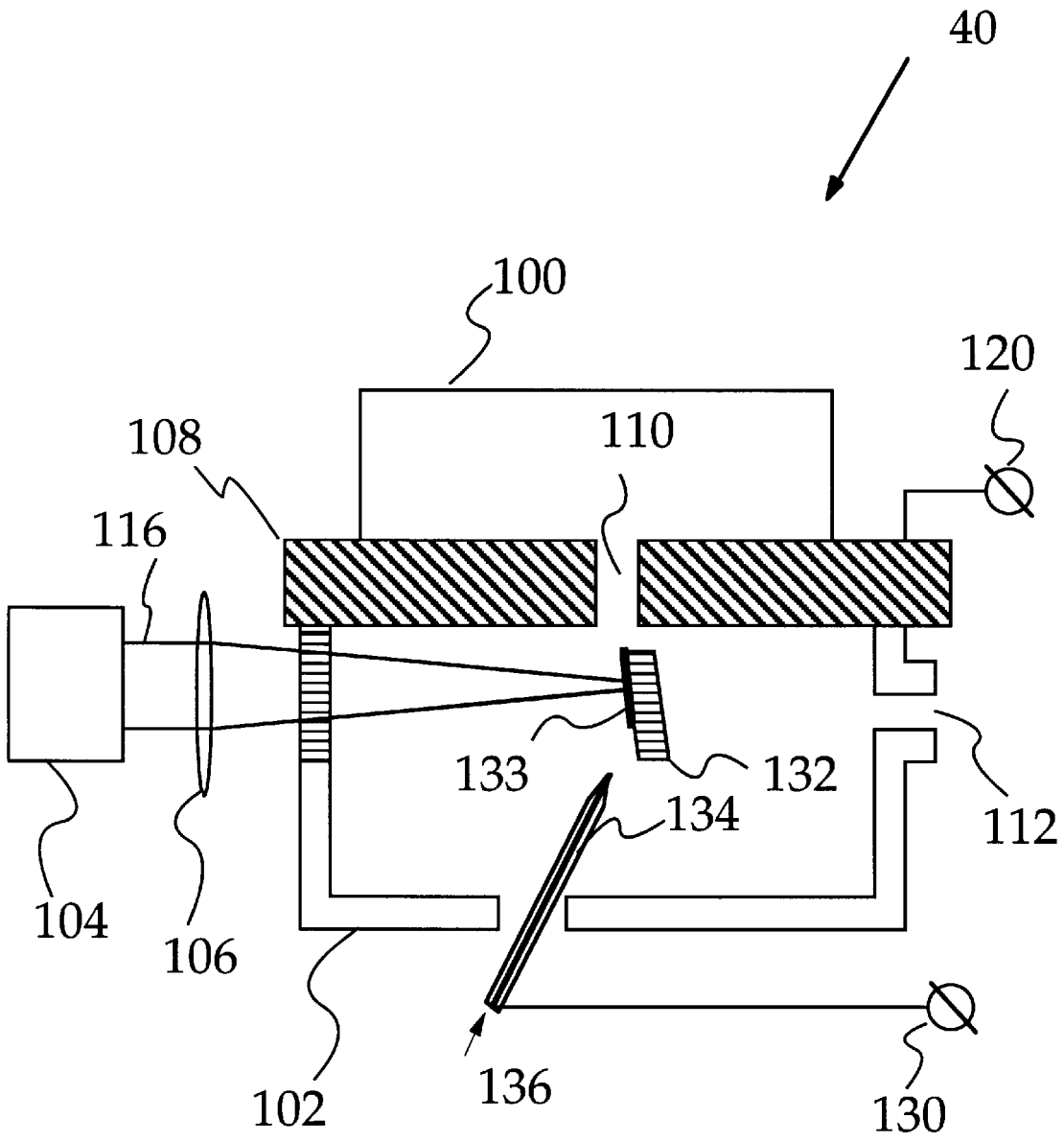
FIG. 4 is a schematic of an AP-MALDI apparatus having a gas nozzle which also serve as an electrode for assisting the transportation of ionized analyte.

FIG. 4 shows another embodiment 40 of the invention. A conductive gas nozzle 134 is introduced into the apparatus. The conductive gas nozzle 134 provide a gas flow 136 directed to the inlet orifice 110 of the interface 108. This conductive gas nozzle 134 is further connected to an electric power supply 130 and serve as an additional electrode of the apparatus. The sample support 132 in this embodiment is insulating instead of conductive. Because an insulating sample support does not disturb the electric field in an ionization region, the target surface 133 of large size is used in this embodiment. The large target surface 133 enables one to deposit a number of different sample spots, and even sample stripes. This construction is particularly useful when the apparatus is interfaced with HPLC or CZE separation techniques.

Figure 5:
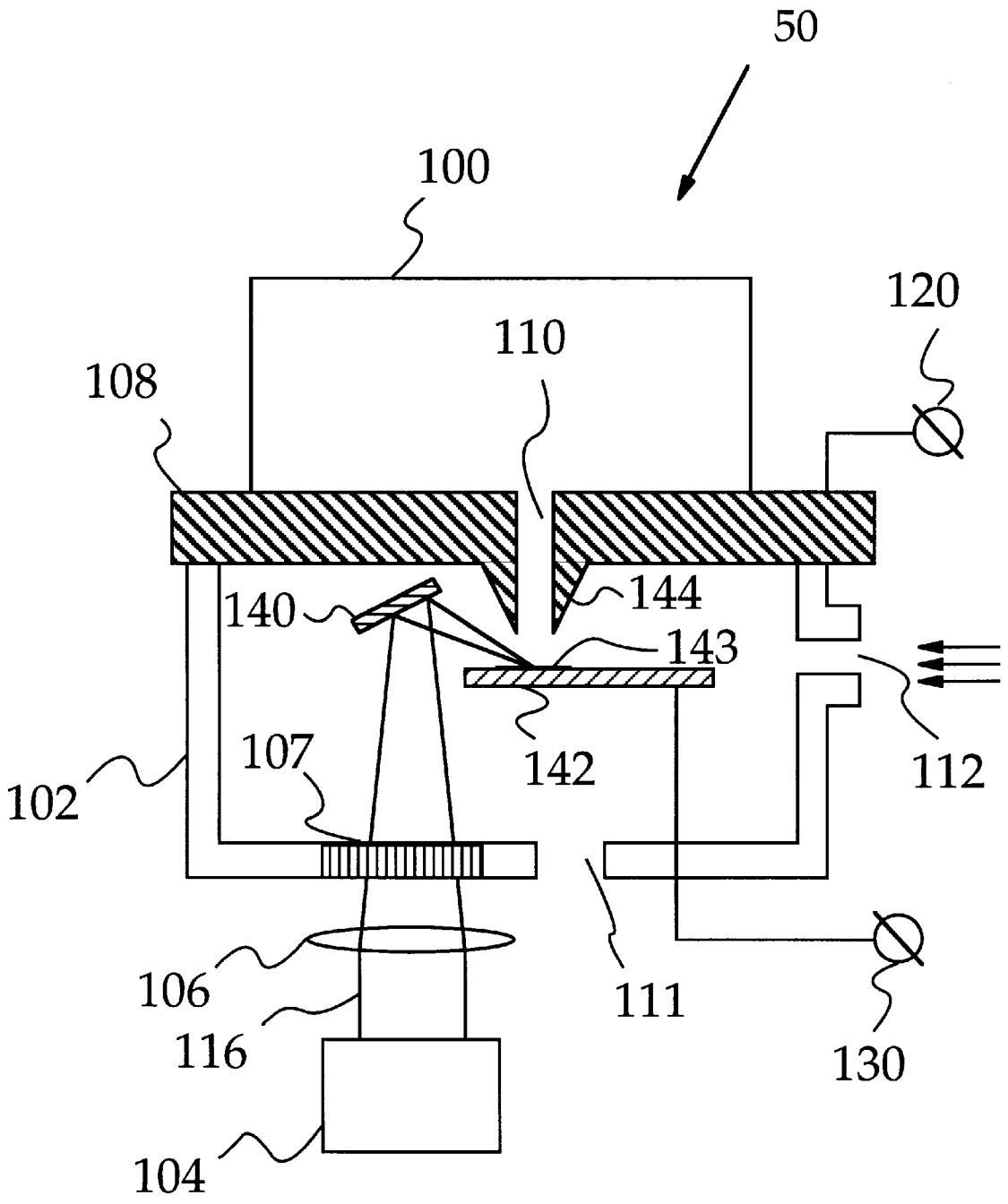
FIG. 5 is a schematic of still another embodiment of an AP-MALDI apparatus having an inlet orifice with a flange.

FIG. 5 represents an embodiment 50 which is a variation of the embodiment 10. This embodiment assumes a flange 144 which is attached to the inlet orifice 110 of the API interface 108. A sample support 142, having a target surface 143 facing the inlet orifice 110, is positioned near the flange 144. A mirror 140 is used to direct the illumination light 116 to the target surface 143 from the direction of the inlet orifice 110. The ion emission from the target surface 143 occurs in the direction of the inlet orifice 110. This arrangement enables a efficient collection of the produced ions for subsequent analysis. The flange 144 further facilitates the collection of the ions, and enhances the sensitivity. Finally, the sample support 142 has a large target surface 143. A number of samples are analyzed by displacing the sample support 142 with respect to the illumination light 116. The ionization chamber 102 has an inlet 112 and an outlet 111 for the bath gas.

EXAMPLES

A "Mariner" orthogonal time-of-flight mass spectrometer of PerSeptive Biosystems is used to detect ions produced by AP-MALDI apparatus. A mixture of analyte and matrix is deposited at the target surface 115 of the sample support 114 by a drop-dry procedure normally used in conventional vacuum MALDI. A potential of 3–5 kV is applied between the sample support electrode 114 and Mariner inlet orifice 110. The sample support electrode 114 has no sharp edges to prevent a corona discharge at this potential. Pulsed laser beam 106 from nitrogen laser (VSL-337ND, Laser Science, Inc.) is used. The laser has a radiation wavelength of 337 nm. The pulse energy of the laser radiation is 250–260 $\mu$j. The laser pulse duration is 4 ns. The beam size of the laser is 40 $mm^2$. The focal length of the lens 106 is 150 mm. The lens position is adjusted to produce the best analyte signal. The focus of the laser beam 116 is found to be 20–30 mm away from the target surface 115, which correspond to a laser spot area of 5–8 $mm^2$ at the target surface 115.

Mass spectra are recorded by Mariner instrument in the accumulation mode: first, the acquisition is started, then the laser power is switched on, and subsequently, the laser spot position, laser spot size, and the laser repetition rate are adjusted to achieve the best result. The acquisition is stopped and the spectrum is saved to a computer disk when the sample material is exhausted and no more ions is recorded. This process typically takes 1-2 minutes and usually 20–40 thousand ion counts are recorded to produce a spectrum.

Figure 6A:
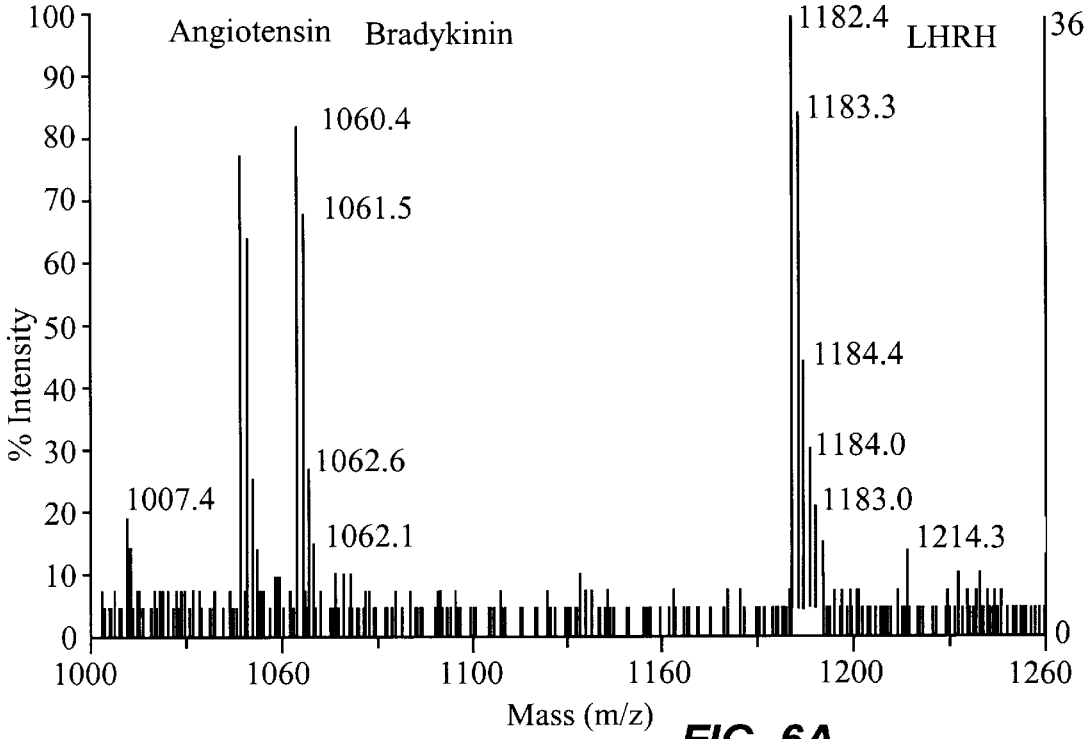
FIG. 6 is an AP-MALDI mass spectrum of the mixture of angiotensin, bradykinin and human LH-RH.
Figure 6B:
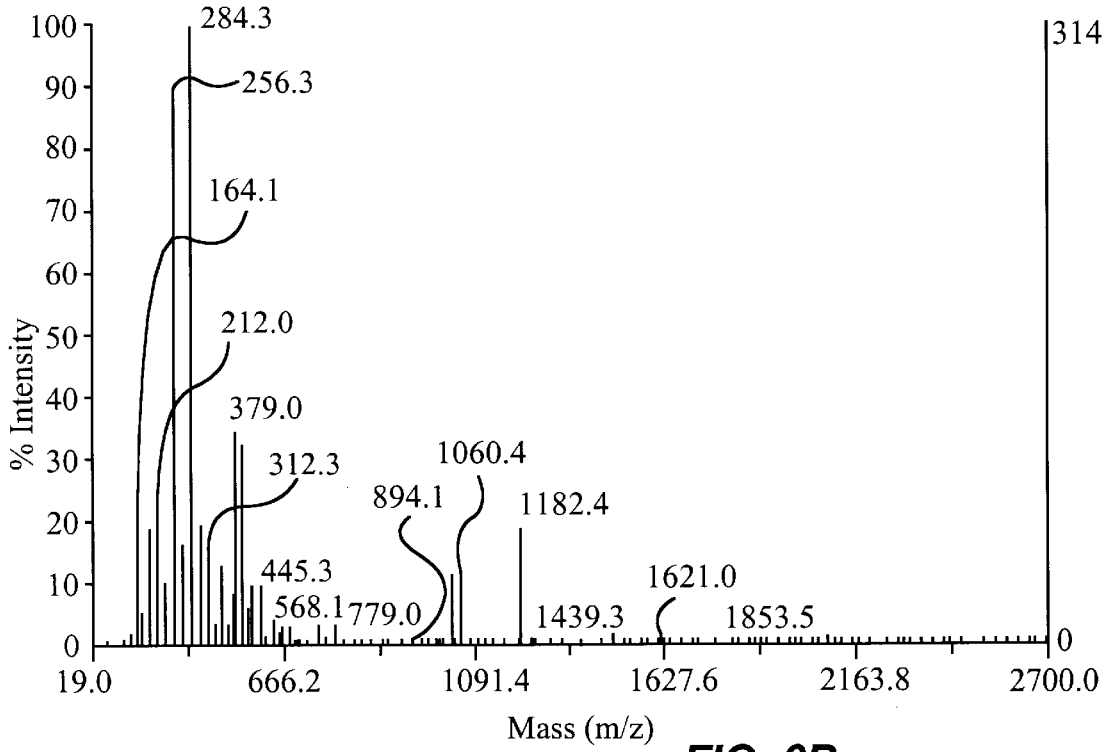

FIG. 6 represents the PA-MALDI spectrum of the mixture of angiotensin, bradykinin and human LH-RH (SIGMA) with monoisotopic molecular ion $MH^+$ weights of 1046.54, 1060.57, and 1182.58, respectively. 2.5 pM of each peptide have been used for the target preparation. The embodiment 20 of PA MALDI source is used.

Figure 7A:
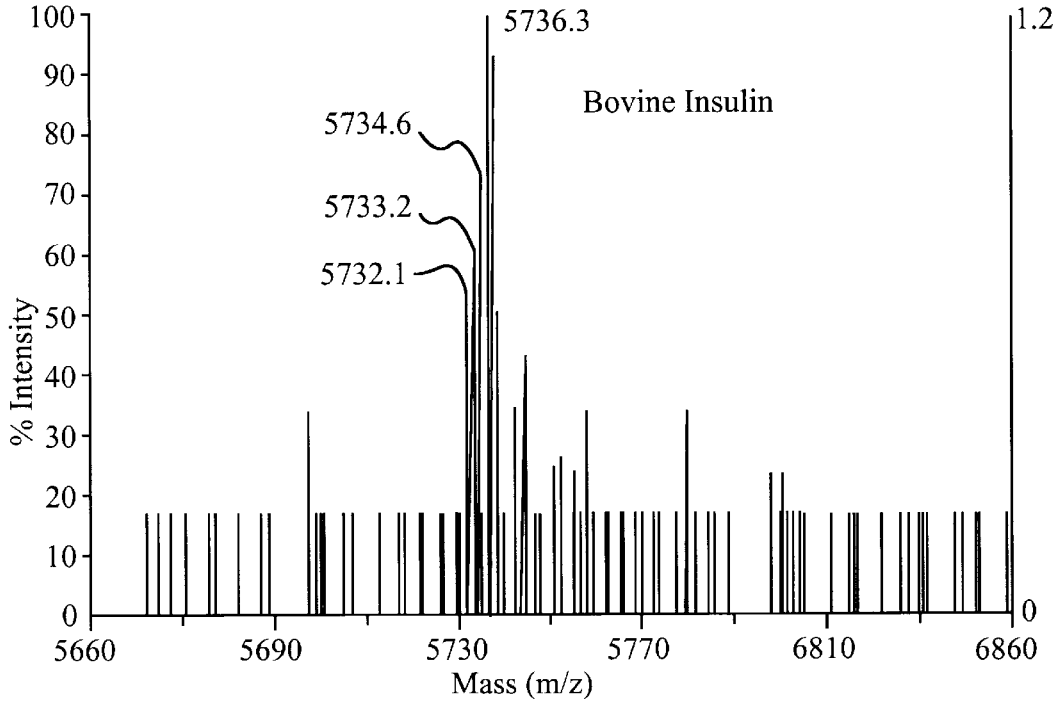
FIG. 7 is an AP-MALDI mass spectrum of 12 pM of bovine insulin.
Figure 7B:
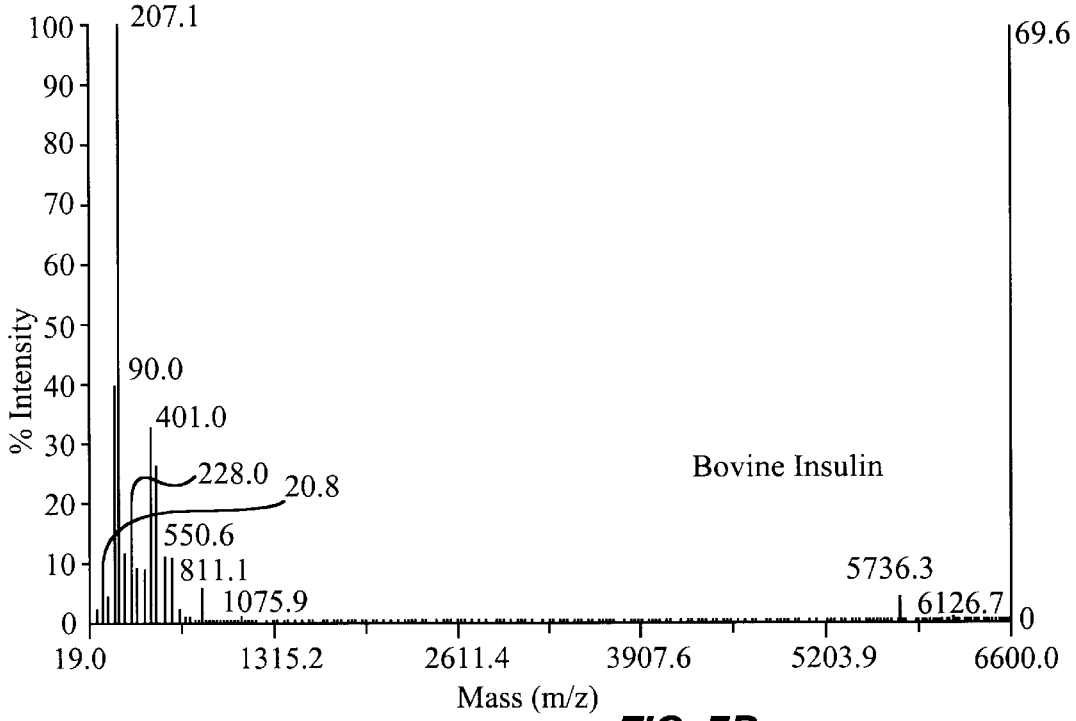

FIG. 7 represents AP-MALDI spectrum of 12 pM of bovine insulin (FW 5733.5, SIGMA). A simplest variant of FIG. 1 in ambient air was used to obtain this spectrum.

Both spectra contain usual matrix peaks in the low mass region and weaker but distinct peaks of singly charged molecular ions of the analytes. The resolution is at Mariner instrument's usual level of 5000. This resolution enables to resolve clearly the isotopic structure of molecular ion peaks.

Peptides and protein molecular ion peaks in FIG. 7 and FIG. 8 demonstrate that AP-MALDI is a non-destructive atmospheric pressure ionization technique. No fragment ions are recorded even at elevated laser light density in contrast to conventional vacuum MALDI. This demonstrates that the AP-MALDI technique is particularly useful for bio-organic sample analysis.

DIFFERENCES BETWEEN MALDI AND AP-MALDI

AP-MALDI takes place under atmospheric pressure conditions. This allows a more or less uniform ion cloud to form after laser illumination, because the produced ions achieve a thermal equilibrium with the surrounding bath gas molecules quickly through collision. As a consequence, the AP-MALDI technique produces a quasi-continuous ion source which provides a stable ion supply to spectrometer.

A more powerful laser pulse is used in AP-MALDI because vibrationally excited analyte ions are quickly thermalized (stabilized) with the surrounding bath gas molecules before they dissociate into fragments. Furthermore, a larger laser spot is used to illuminate the sample, which allows an easier alignment procedure in comparison with the vacuum MALDI technique. As a consequence, substantial amount of ions, as much as a few picomoles, are generated in AP-MALDI to compensate for the loss due to API.

AP-MALDI has an ion source which is external with respect to the spectrometer instrument. Thus any mass spectrometer equipped with Atmospheric Pressure Interface (API) may be easily coupled with this ion source without undue effort. The de-coupling of ion source from the ion-focusing optics of a spectrometer ensure the same resolution level and spectra calibration procedure as for any other atmospheric pressure ionization technique. As a result, other atmospheric pressure separation techniques, such as Ion Mobility Spectroscopy, may be easily coupled with AP-MALDI.

Atmospheric pressure character of AP-MALDI allows simple sample loading procedure. Consequently, the construction of the instrument is simplified drastically. Both sample preparation and ionization processes take place under atmospheric pressure conditions. This enables a simple and straightforward way for on-line coupling of AP-MALDI with such separation techniques as HPLC and CZE.

AP-MALDI is a versatile technique. The selection of possible matrix material for AP-MALDI is not limited to solids or liquid matrixes with very low vapor pressures. Matrixes of volatile liquids may be used under atmospheric pressure conditions.

Furthermore, AP-MALDI achieves ionization and desorption of the analyte in a single step. This property of AP-MALDI allows simple equipment construction and operation, which also makes AP-MALDI advantageous over prior art which is discussed in the background section. Prior art relies on a two step process: a laser beam decomposes matrix molecules in order to release the analytes; the released analyte is subsequently ionized by atmospheric pressure chemical ionization process.

A detailed explanation of the invention is contained in the detailed specification with reference to the appended drawing figures.

In view of the above, the scope of the invention should be determined by the following claims and their legal equivalents.

What is claimed is:

1. An atmospheric-pressure ionization device for connection to a spectrometer, comprising:

a) an atmospheric-pressure ionization chamber;

b) a sample support positioned within said ionization chamber;

c) a sample placed on said sample support, and comprising an analyte embedded in an ionization-assisting matrix chosen such that said matrix facilitates ionization of said analyte to form analyte ions upon light-induced release of said analyte from said sample;

c) a laser for illuminating said sample, to induce said release of said analyte from said sample, and to induce ionization of said analyte to form said analyte ions; and d) an interface connecting said ionization chamber and said spectrometer for capturing said analyte ions released from said sample and for transporting said analyte ions to said spectrometer.

2. The atmospheric-pressure ionization device of claim 1 wherein said interface comprises a conductive inlet orifice, maintained at a first electric potential.

3. The atmospheric-pressure ionization device of claim 2 wherein said sample support is conductive and is maintained at a second electrical potential that is different from the first electrical potential.

4. The atmospheric-pressure ionization device of claim 2 further comprising an electrode for providing a third electrical potential.

5. The atmospheric-pressure ionization device of claim 1 wherein said sample support is positioned in the proximity of an inlet orifice of said interface.

6. The atmospheric-pressure ionization device of claim 1 further comprising a gas entrance means, providing compressed gas flow for assisting the transportation of said analyte ions from said sample support to said interface.

7. The atmospheric-pressure ionization device of claim 1 wherein said analyte and said ionization-assisting matrix are in a phase selected from the group consisting of solid phase and liquid phase.

8. The atmospheric-pressure ionization device of claim 1 further comprising a lens for focusing a light beam generated by said laser.

9. The atmospheric-pressure ionization device of claim 1 further comprising a movable means on which said sample support is mounted for scanning said sample illuminated by said laser during a operation process.

* * * * *

UNITED STATES PATENT AND TRADEMARK OFFICE

CERTIFICATE OF CORRECTION

PATENT NO. : 5,965,884
DATED : October 12, 1999
INVENTOR(S) : Victor V. Laiko

It is certified that error appears in the above-identified patent and that said Letters Patent is hereby corrected as shown below:

Column 1, line 4, insert--

This invention was made with Government support under Grant No. RR01614, awarded by the National Institutes of Health. The Government has certain rights in this invention."--

Signed and Sealed this

Fourth Day of April, 2000

*Attest:*

Q. TODD DICKINSON

*Attesting Officer*

*Director of Patents and Trademarks*